US006745429B2

(12) United States Patent
Ng

(10) Patent No.: US 6,745,429 B2
(45) Date of Patent: Jun. 8, 2004

(54) MOP WITH WRINGING OPERATION

(76) Inventor: Kim Kwee Ng, 10 Malibu La., Centereach, NY (US) 11720-3042

( * ) Notice: Subject to any disclaimer, the term of this patent is extended or adjusted under 35 U.S.C. 154(b) by 239 days.

(21) Appl. No.: 10/004,443

(22) Filed: Dec. 5, 2001

(65) Prior Publication Data

US 2003/0079307 A1 May 1, 2003

(51) Int. Cl.[7] ..... A47L 13/14

(52) U.S. Cl. ..... 15/116.1; 15/120.1; 15/263; 15/229.1

(58) Field of Search ..... 15/116.1, 114.1, 15/260, 263, 118, 120.1, 120.2, 229.1, 229.2

(56) References Cited

U.S. PATENT DOCUMENTS 5,060,338 A * 10/1991 Yates et al. ..... 15/119.2
5,675,858 A * 10/1997 von Meyer ..... 15/119.1
5,913,347 A * 6/1999 Wilen ..... 15/115
5,996,161 A * 12/1999 Facca ..... 15/120.1
6,125,494 A * 10/2000 Morad ..... 15/120.2
6,212,728 B1 * 4/2001 Facca et al. ..... 15/120.2
6,427,280 B1 * 8/2002 Specht ..... 15/120.2

* cited by examiner

*Primary Examiner*—Robert J. Warden, Sr.
*Assistant Examiner*—Shay L Balsis

(57) ABSTRACT

Absorbent mop strands of a mop are held captive by a pair of walls in a sleeve at the terminal ends thereof after the sleeve is slid over a mop head. The mop strands are wrung dry by rotating the sleeve with respect to the handle of the mop.

In another embodiment of the invention, a tubular member is disposed coaxially and rotatable about a sleeve. Mop strands caught in the passageway defined by a first pair of walls in the tubular member near the terminal ends of the mop strands are twisted with respect to the upper portion of the mop strands held captive by a second pair of walls in the sleeve near the distal end of the mop handle, resulting in a wringing action of the mop head. In another embodiment of the invention, a mop comprises a scrubber depending from a distal end of the sleeve mounted co-axially on the handle of the mop.

8 Claims, 4 Drawing Sheets

MOP WITH WRINGING OPERATION

FIELD OF THE INVENTION

The invention relates generally to mops for cleaning floors, and more particularly to a mop that can be wrung by rotating a sleeve slidably disposed on the handle of the mop.

DESCRIPTION OF THE PRIOR ART

Many devices have addressed the shortcomings often associated with the operation of a wringing mop. U.S. Pat. No. 6,212,728 describes a self-wringing ratchet mop with a tubular member having at least one pawl. When the pawl engages one of the longitudinal channels built in the elongated handle, the tubular member is rotatable in only one direction, thereby preventing slippage or unintended rotation of the mop strands during a wringing operation. The pawl is disengaged from the longitudinal channel by moving the tubular member along the axis of the handle, thus freeing the mop strands from wringing.

U.S. Pat. No. 5,675,858 describes a string mop with a wringer which is slid from a first position to a second position over a wet mop head of a mop to extract water. Mop strands are wrung by forcing a collar over a pleated sleeve which compresses the enclosed mop head.

Many of the prior art wringing mops are very complicated in design, usually involving many structural components. Some of the wringing mop systems have obvious advantages; however, they are expensive to manufacture.

It is the object of the present invention to provide a wringing mop which is simpler to manufacture and operate than the prior art wringing mops.

SUMMARY OF THE INVENTION

A hollow sleeve, sidably disposed on the handle of the mop, comprises at least one pair of longitudinal walls protruding from the interior surface of the sleeve. As the sleeve is slid over a wet mop head of the mop, the terminal ends of mop strands are retainably held captive in the passageway formed by the walls. The mop strands are wrung dry by rotating the sleeve with respect to the handle of the mop.

In another embodiment of the invention, a tubular member is disposed coaxially and rotatable about a sleeve. Mop strands caught in the passageway defined by a first pair of walls in the tubular member near the terminal ends of the mop strands are twisted with respect to the upper portion of the mop strands held captive by a second pair of walls in the sleeve near the distal end of the mop handle, resulting in a wringing action of the mop head. In another embodiment of the invention, the mop comprises a scrubber depending from a distal end of the sleeve mounted co-axially on the handle of the mop.

DESCRIPTION OF THE PREFERRED EMBODIMENTS

Figure 1:
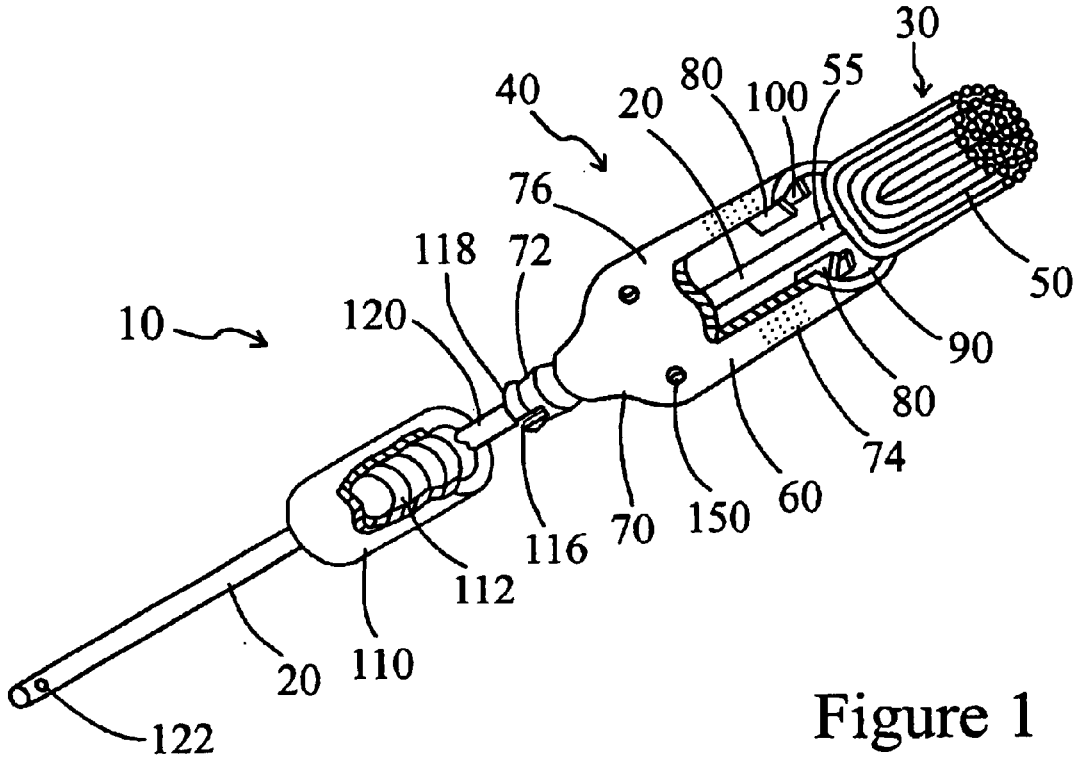
FIG. 1 is a simplified diagram of a first preferred embodiment of the invention, illustrating a mop with a sleeve.

Referring now to the first preferred embodiment of the invention shown in FIG. 1, wherein a mop 10, having a longitudinal elongated handle 20 and a mop element 30, comprises a wringing member 40. Mop element 30 comprises a plurality of absorbent material strands 50 depending from a distal end 55 of the mop handle 20. Mop strands 50 are preferably made of a suitably absorbent material such as cotton, yarn, sponge or the like. Wringing member 40, comprising an open-ended hollow sleeve 60 at one end and a radially extending, annular shoulder member 70 contiguous with a flexible externally threaded neck 72 at the other end, is slidably and rotatably disposed coaxially on the handle 20 and over the absorbent mop strands 50. Sleeve 60 generally comprises a hand grip section 74 and a generally frustoconically shaped section 76. Sleeve 60 includes at least a pair of preferably thin planar walls 80, protruding radially from and extending along the interior wall surface 90 of the sleeve 60. Each member in a pair of the thin walls 80 is preferably arranged to be close to each other to form a narrow passageway 100 through which some of the mop strands 50 can slidably pass. Thin walls 80 are relatively short lengthwise compared to those of the stretched mop strands 50, and are aligned substantially parallel to the longitudinal axis of the mop handle 20.

Locking collar 110, comprising an internally threaded tapered bore 112, is detachably and rotatably disposed co-axially on the mop handle 20. Threaded tapered bore 112 with its inner diameter decreasing with the depth of the threaded bore 112, is threadingly engaged with the flexible threaded neck 72 of the wringing member 40. The wringing member 40 includes a plurality of longitudinal slits 116 at the rim 118 of the threaded neck 72. Sleeve 60 is slid along the handle 20 until the mop strands 50 are exposed for floor cleaning. Locking collar 110 is slid along the handle 20 to threadingly engage the threaded neck 72 of the wringing member 40. Locking collar 110 is rotated until the rim 118 of the threaded neck 72 is pressing against the exterior surface 120 of the handle 20. The locking collar 110 is tightened to produce enough frictional force in preventing slippage of the sleeve 60 along the handle 20, thus detachably fixing the sleeve 60 on the handle 20. The thickness of the rim 118 of the threaded neck 72, the material used and the size of the slits 116 are properly selected so that the threaded neck 72 of the wringing member 40 is flexible and deformable to be pressed against the handle 20 by the locking collar 110.

Mop 10 includes a hook-engaging eyelet 122 at the proximal end of the handle 20 for the upright storage of the mop 10 when not in use.

Figure 2:
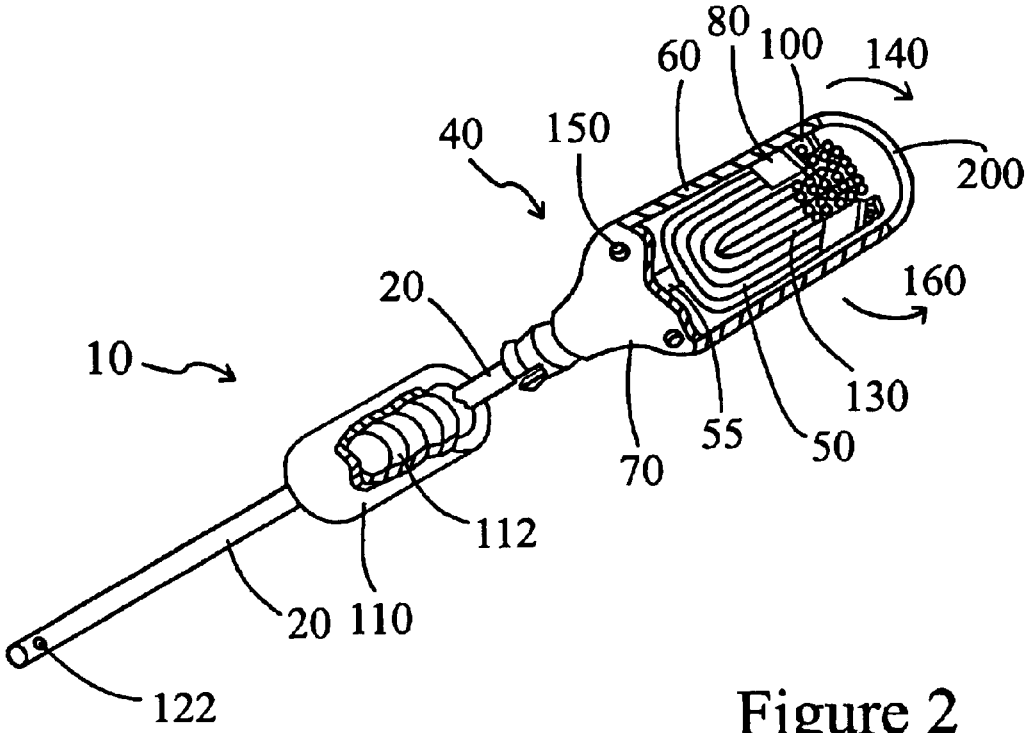
FIG. 2 is a simplified diagram showing a plurality of mop strands in a sleeve.

Referring now to FIG. 2, locking collar 110 is threadingly disengaged and released from the neck 72 of the wringing member 40, the sleeve 60 is free to slide along the handle 20 and over to cover the wet mop strands 50. Thin walls 80 in the sleeve 60 engage the terminal ends 130 of absorbent mop strands 50. End portion of some of the mop strands 50 is frictionally held captive and retainable in the passageway 100 formed by the walls 80 in the sleeve 60. Intermediate portion of the mop strands 50 stretched between the thin walls 80 and the distal end 55 of the mop handle 20 is twisted and compressed inwardly, when the sleeve 80 is rotated with respect to the longitudinal axis of the mop handle 20 in a first, clockwise direction as shown by a curved arrow 140. Moisture and liquid are squeezed from the absorbent mop strands 50 and are allowed to flow downwardly and out from the enclosing sleeve 60 through a one of a plurality of through openings 150 on the sleeve 60. Mop strands 50 twisted by the rotating sleeve 60 are thereby wrung from the moisture and liquid which have been absorbed during use of the mop 10.

During a relative rotation of the sleeve 60 and the mop handle 20, walls 80 are used to function as an obstructing means to block or retard the linear movement of the mop strands 50, when the terminal ends 130 of the mop strands 50 are being confined and held captive in the passageway 100 formed by the walls 80, thereby preventing slippage of the mop strands 50 in the sleeve 60.

Mop strands 50 is returned to its original, unwound condition by rotating the sleeve 60 in a second, anti-clockwise direction shown by a curved arrow 160, with respect to the longitudinal axis of the handle 20 of mop 10. Sleeve 60 is slid along the handle 20 until the mop strands 50 are again exposed for cleaning. Locking collar 110 is rotated to tighten the sleeve 60 to the mop handle 20. Mop strands 50 can be changed and replaced by releasing the locking collar 110 from the handle 20 and by tapping the handle 20 gently towards the ground surface until the sleeve 60 disengages completely from the absorbent mop strands 50, while holding the sleeve 60 in the upright position.

There are mops of different sizes. The total number of absorbent strands 50 in a mop element 30 can vary from one to another. A slightly different approach is employed in an event that the total number of mop strands 50 in a mop element 30 is very much less than the desirable optimal number, which is the number of mop strands that would fill up the space around the rim 200 of the sleeve 60 slidably disposed on the mop handle 20.

Figure 3:
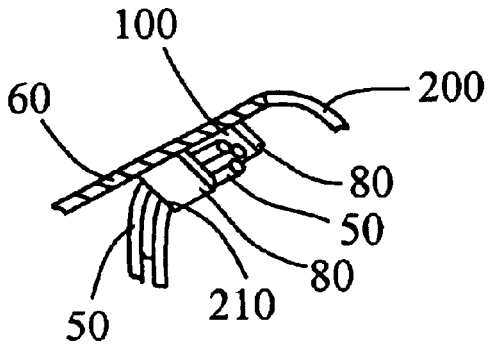
FIG. 3 is a simplified diagram of a portion of the first preferred embodiment showing mop strands being bent at the edge of a longitudinal wall mounted on the interior wall surface of a sleeve (partially shown).

Referring now to FIG. 3, mop strands 50 caught in the passageway 100 formed by a pair of thin walls 80 in the sleeve 60 of FIG. 2 are bent when the sleeve 60 is rotated with respect to the longitudinal axis of the handle 20 of mop 10 of FIG. 2. A first edge 210 of the wall in contact with the bent mop strands 50 is preferably coarse to retard the linear movement of the bent mop strands 50. The selected first edge 210 of the thin walls 80, when in contact with the bent mop strands 50 and together with the frictional force produced by the individual mop strand 50 against each other, impedes and resists further linear movement of the mop strands 50 caught in the narrow passageway 100 defined by the pair of thin walls 80 in FIG. 3.

Figure 4:
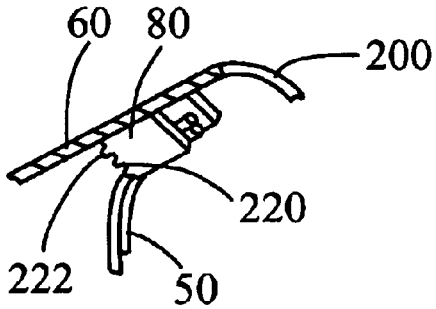
FIG. 4 is a simplified diagram showing an edge of the wall having an irregular shape for the entrapment of the mop strands.

Referring now to FIG. 4, an edge 220 of at least a one of the thin walls 80 having an irregular shape 222, is engaged with the mop strands 50 to resist linear movement of the mop strands 50 when the sleeve 60 is rotated with respect to the mop handle 20 of FIG. 2. The irregular shape 222 of the thin walls 80 at the edge 220 increases the area of contact for the entrapment of the mop strands 50 to retard the linear movement of the mop strands 50 when the mop strands 50 are bent around the edge 220 of the thin walls 80 inside the sleeve 60 of FIG. 2.

Figure 5:
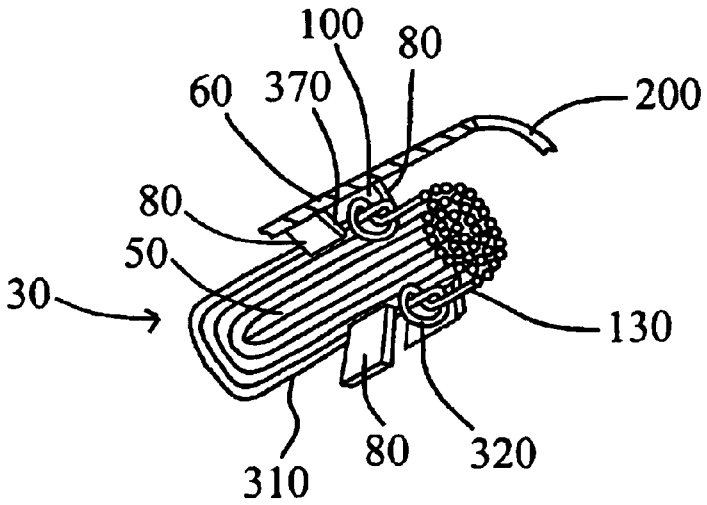
FIG. 5 is a simplified diagram showing some of the mop strands having a plurality of knots tied at the terminal ends thereof.

Referring now to FIG. 5, a few of the absorbent mop strands 50 near the outer fringe area 310 of the mop element 30 are selected to have knots 320 tied at the terminal end 130 of each of these selected mop strands 50. These mop strands 50 that have knots 320 tied at their terminal ends 130 are held captive and retainable in a small narrow passageway 100 defined by the walls 80 in the sleeve 60. Some of these mop strands 50 are held captive against slippage when the knots 320 of these mop strands 50 are stopped at a second edge 370 located outwardly towards the rim 200 of the sleeve 60. During a relative rotation of the sleeve 60 and the handle 20 of FIG. 2, these absorbent mop strands 50, having the knots 320 tied at their terminal ends 130, are wrapped around other inner layers of the mop strands 50, squeezing and forcing liquid and moisture out from the mop strands 50 of the mop 10 of FIG. 2. Mop strands 50 are thereby wrung dry by the rotating sleeve 60 with respect to the mop handle 20 of FIG. 2.

Figure 6:
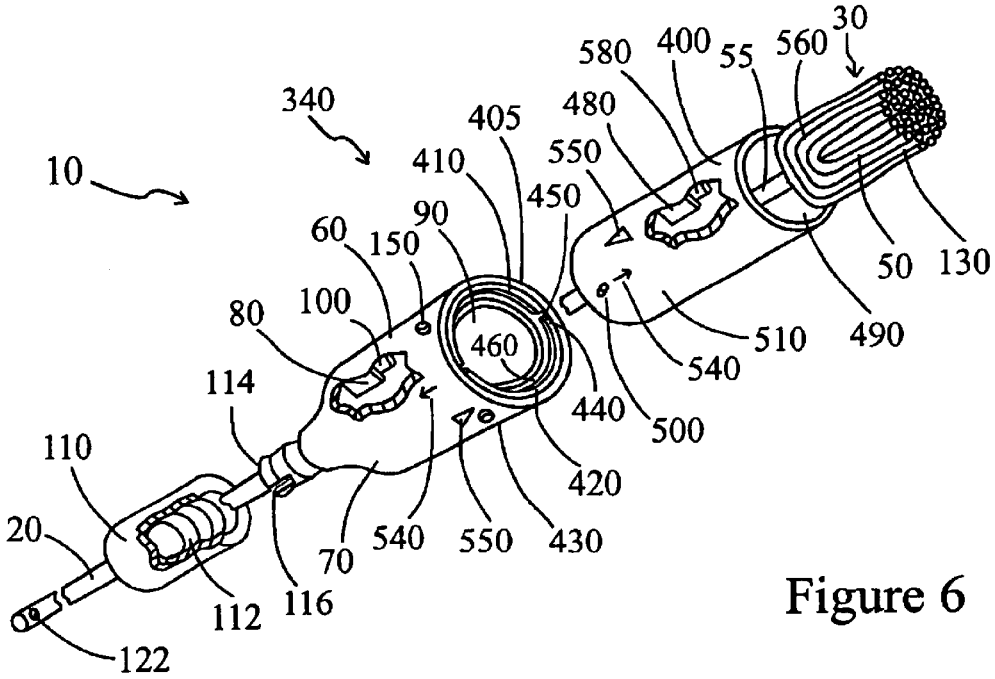
FIG. 6 is a simplified diagram of a second preferred embodiment of the invention showing a mop having two cooperating members, a sleeve and a tubular element, both retainably disposed coaxially on the handle of the mop.

Referring now to the second preferred embodiment of the invention shown in FIG. 6, wherein a mop 10, having a longitudinal elongated handle 20 and a mop element 30, comprises an operating member 340. Mop element 30 comprises a plurality of absorbent material strands 50 depending from a distal end 55 of the mop handle 20. Operating member 340, comprising two cooperating members, a sleeve 60 and a hollow tubular member 400, is slidably and rotatably disposed coaxially on the handle 20 and over the absorbent mop strands 50. Sleeve 60, having an open end 405 at one end and a radially extending, annular shoulder body 70 at the other end, includes at least a first pair of preferably thin planar walls 80, protruding radially from the interior wall surface 90 of the sleeve 60. Each member in a pair of the thin walls 80 is preferably arranged to be close to each other to form a narrow passageway 100 through which some of the mop strands 50 can slidably pass. Thin walls 80 are aligned substantially parallel to the longitudinal axis of the mop handle 20.

Figure 7:
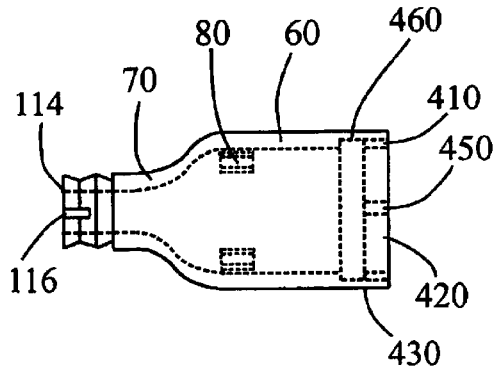
FIG. 7 is a side view of the sleeve member.
Figure 8:
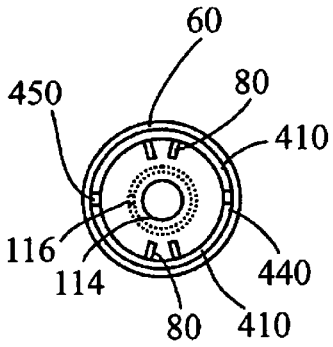
FIG. 8 is a end view of the sleeve member.

Referring now to FIGS. 6, 7, and 8, sleeve 60 includes a pair of split-rings 410 inserted into a cut-away circular section 420 at the bottom portion 430 of the sleeve 60. Split-rings 410 are fixedly mounted inside the sleeve 60 using glue, threaded bolts or the like. Split-rings 410 are positioned with their terminal ends 440 facing each other to form two longitudinal channels 450. An inner circular track 460 is formed directly behind the split-rings 410 inside the sleeve 60.

Tubular member 400, having at least a second pair of walls 480 protruding from the interior wall surface 490 of the tubular member 400, comprises two pole members 500 protruding outwardly in a radial direction from the exterior surface 510 of the tubular member 400. Pole members 500 are adapted for insertion into the longitudinal channels 450 and are rotatably retainable in the inner circular track 460 of the sleeve 60. The pole members 500 are inserted through the longitudinal channels 450 into the inner circular track 460 of the sleeve 60. Tubular member 400 is coupled rotatably to the sleeve 60 when the pole members 500 of the tubular member 400 are sliding along the inner circular track 460 of the sleeve 60. Walls 480 include features which are similar to the walls 80 discussed in the foregoing embodiment of the cleaning mop 10 in FIGS. 2, 3 and 4.

Indicia 540 are marked on the sleeve 60 and on the tubular member 400 to indicate where the sleeve 60 and the tubular member 400 may be disengaged for disassembly. Indicia 550 are marked on the sleeve 60 and on the tubular member 400 to indicate where the pole members 500 are positioned along the circular track 460 other than being directly behind the longitudinal channels 450, when the mop 10 is ready for use in a moping or a wringing operation.

Locking collar 110, discussed in the first embodiment of the mop 10 in FIG. 1, is retainably disposed on the handle 20. Sleeve 60 is disengaged and released from the locking collar 110 by untightening the locking collar 110 when the indicia 550 on the sleeve 60 and on the tubular member 400 are aligned with each other. Tubular member 400, after having been coupled together with the sleeve 60, is slid along the handle 20 and over the absorbent mop strands 50. The first pair of walls 80 in the sleeve 60 engages the upper portion 560 of the mop strands 50 near the distal end 55 of the mop handle 20, the second pair of walls 480 in the tubular member 400 engages the terminal ends 130 of the mop strands 50. In a wringing operation, the terminal ends 130 and the upper portion 560 of the mop strands 50 are held captive in their respective passageways 100 and the passageways 580 defined respectively by the walls 80 and walls 480, during a relative rotation of the tubular member 400 and the sleeve 60. The intermediate portion of the mop strands 50 stretched between the first pair of the walls 80 and the second pair of the walls 480 is twisted by the relative rotation of the tubular member 400 and the sleeve 60, thereby wringing from the mop strands 50 the moisture and liquid absorbed during a moping operation. Moisture and liquid squeezed from the absorbent mop strands 50 are allowed to flow downwardly and out from the enclosing sleeve 60 through one of the plurality of through openings 150 on the sleeve 60.

Figure 9:
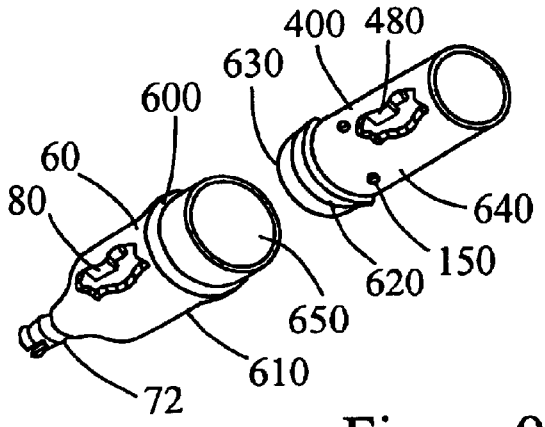
FIG. 9 is a simplified diagram showing a sleeve having a circular groove adapted for use with a rotatable tubular element.

Referring now to FIG. 9, wherein another simple way of engagement for a sleeve 60 with a tubular member 400 is illustrated. Sleeve 60 includes a circular groove 600 embedded in the sleeve 60. A flexible ridge or a deformable annular tapered ring 620, with a thickness that is decreasing towards the rim 630 of the tubular member 400, is mounted on the exterior surface 640 of the tubular member 400. Tubular member 400 is forcibly inserted into the inner passageway 650 of the sleeve 60, with the annular ring 620 entering into the circular groove 600 of the sleeve 60. Tubular member 400 is coaxially coupled to and rotatable about the sleeve 60, with the annular ring 620 rotating in the circular groove 600 of the sleeve 60. Annular ring 620 is fixedly mounted on the exterior surface 640 of the tubular member 400 using adhesive or the like.

Figure 10:
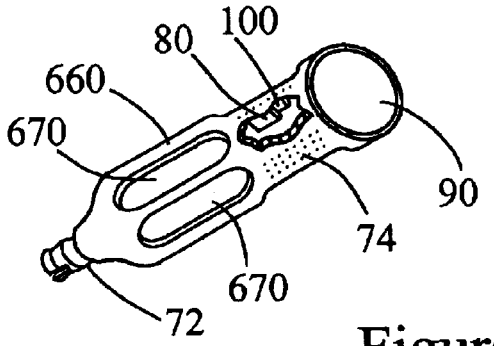
FIG. 10 is s a simplified diagram showing a wringing member having a body with several elongated openings.

Though the sleeve 60 is used to illustrate the wringing operation of the mop element 30 in the foregoing embodiments, it is obvious that the body of the sleeve 60 may have a variety of shapes. Referring now to FIG. 10, a wringer or a wringing member 660, having a hollow body with a plurality of elongated openings 670 for a better visibility in a rotating operation, comprises a plurality of walls 80 protruding from the interior wall surface 90 of the wringing member 660. Walls 80 in the wringing member 660 are used to function as an obstructing means to block or retard the linear movement of the mop strands 50 of FIG. 2, when the terminal ends 130 of the mop strands 50 of FIG. 2 are being confined and held captive in the passageway 100 formed by the walls 80, thereby preventing slippage of the mop strands 50 in the passageway 100 of the wringing member 660 upon a relative rotation of the wringing member 660 and the mop handle 20 of FIG. 2.

Figure 11:
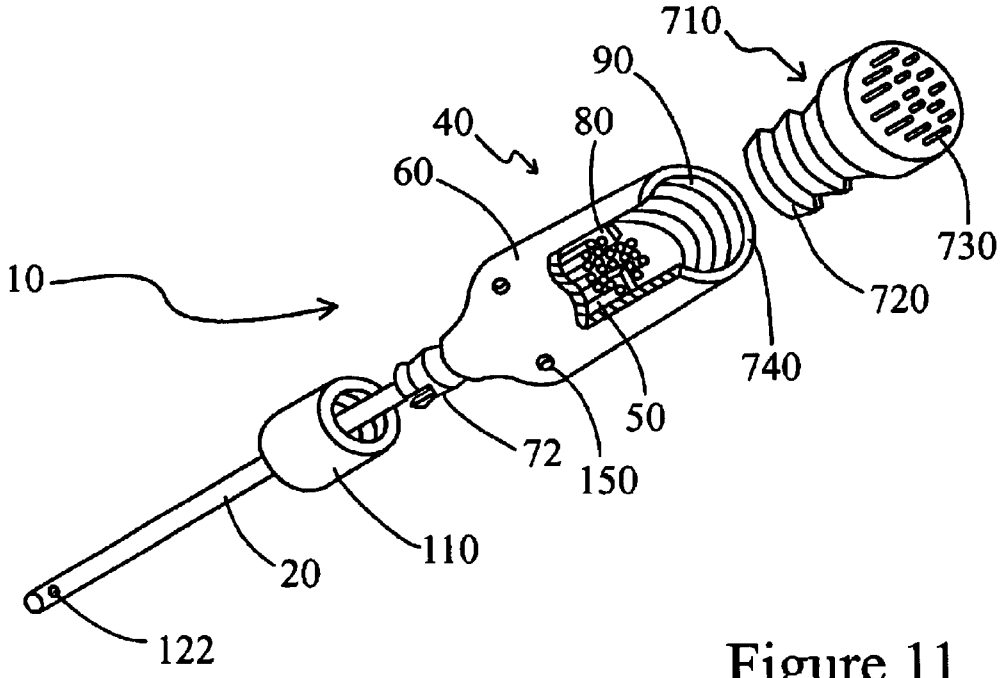
FIG. 11 is a simplified diagram of a third preferred embodiment of the invention showing a mop having a scrubber for cleaning the floor surface.

Referring now to the third preferred embodiment of the invention shown in FIG. 11, wherein a scrubber element 710, having an externally threaded body 720 mounting an abrasive member 730, is mounted on the distal end 740 of a sleeve 60. Sleeve 60 is discussed in detail in the foregoing embodiment of the mop 10 in FIG. 1. An abrasive member 730 can be an abrasive pad, brush or similar coarse material. Portion of the interior wall surface 90 of the sleeve 60 is internally threaded and the scrubber element 710 is retainably disposed on the distal end 740 of the sleeve 60.

Having described the invention and its preferred modes of operation in sufficient detail for those of normal skill in the art to practice the same, it will be obvious to such practitioners to make certain changes and variation in the specific elements of the disclosed embodiments without departing from the scope of the invention. For example, a plurality of longitudinal walls 80 protruding from the interior wall surface of the sleeve 60 can be employed in FIG. 2. Walls 80 are mounted in spaced apart relationship with each other in the sleeve 60 to resist linear movement of the mop strands 50, when the mop strands 50 are bent and twisted during a relative rotation of the sleeve 60 and the mop handle 20. A suitably dimensioned longitudinal wall 80 having a coarse surface on its face may be deployed in the sleeve 60, the wringing result may vary, depending on the size and the number of the mop strands 50 in the mop 10. It is also possible that rather than having a plurality of knots 320 tied at the terminal ends 130 of the mop strands 50, the thickness at the terminal ends 130 of the mop strands 50 may be increased by using thicker cotton or by attaching fabric or other obstructing material, etc to retard linear movement and prevent slippage of the mop strands through the passageway 100 formed by the walls 80. Though the thin planar walls 60 are used in the foregoing embodiments, wall in an arcuate shape or in a corrugated form can also be employed. A plurality of ball bearings may be used to substitute the annular ring 620 for a relatively smooth rotation of the tubular member 400 with respect to the sleeve 60 in FIG. 9.

It is clear that the foregoing disclosure is merely illustrative of the principles of the present invention. Various modifications and additions, apparent to those skilled in the art, may be made without departing from the spirit and broader aspects of this invention as defined in the appended claims.

What is claimed is:

1. A device defining a mop for cleaning floors, comprising:

a) a longitudinal elongated handle having a distal end for attaching a mop element;

b) said mop element comprising a plurality of absorbent mop strands;

c) a wringing member having a hollow body disposed slidably along said handle and over said mop element, said wringing member comprising a first obstructing means for engaging and confining said mop strands at terminal ends thereof, thereby preventing slippage of said mop strands from said obstructing means upon a rotation of said wringing member with respect to said handle; and d) a tubular member having a second obstructing means mounted on the interior wall surface of said tubular member for relative rotation with said wringing member, thereby wringing moisture from mop strands of said mop.

2. The device of claim 1, wherein said first obstructing means defining a plurality of longitudinal walls protruding from the interior surface of said wringing member, with said wringing member being slidable to a position whereby said mop strands are wrung while being held captive at terminal ends thereof in a passageway defined by said walls upon a rotation of said wringing member with respect to said handle.

3. The device of claim 2, wherein said mop strands includes a means at terminal ends thereof to prevent slippage of said mop strands passing by said walls in said wringing member.

4. The device of claim 2, wherein said wringing member includes a plurality of walls in irregular shape for entrapment of said mop strands.

5. The device of claim 1, wherein said second obstructing means defining a plurality of walls protruding from the interior wall surface of said tubular member to engage said mop strands enclosed in said tubular member, with said walls being aligned substantially parallel to the longitudinal axis of said handle.

6. The device of claim 1, wherein said wringing member includes a circular track adapted for rotation of said tubular member in said track.

7. The device of claim 1, wherein said mop comprises a means for releasably attaching said wringing member on said handle.

8. The device of claim 1, wherein said mop includes a scrubber depending from a distal end of said wringing member.

* * * * *